US005482776A

United States Patent [19]

Nishiyama et al.

[11] Patent Number: 5,482,776

[45] Date of Patent: Jan. 9, 1996

[54] VISCOSE RAYON FIBER HAVING SUPERIOR APPEARANCE

[75] Inventors: Kazunari Nishiyama; Koichi Konomoto, both of Nobeoka, Japan

[73] Assignee: Asahi Kasei Kogyo Kabushiki Kaisha, Osaka, Japan

[21] Appl. No.: 218,304

[22] Filed: Mar. 25, 1994

Related U.S. Application Data

[63] Continuation of Ser. No. 858,428, Mar. 24, 1992, abandoned, which is a continuation of Ser. No. 414,665, Sep. 29, 1989, abandoned.

[30] Foreign Application Priority Data

Oct. 5, 1988 [JP] Japan ..... 63-249981
May 2, 1989 [JP] Japan ..... 1-112165

[51] Int. Cl.[6] ..... D02G 3/00

[52] U.S. Cl. ..... 428/400; 428/364; 428/393; 428/397; 428/399

[58] Field of Search ..... 428/399, 400, 428/393, 364, 397

[56] References Cited

U.S. PATENT DOCUMENTS

| | | | |
|---|---|---|---|
| 1,944,378 | 1/1934 | Thenoz | 57/248 X |
| 2,302,077 | 11/1942 | Von Kohorn | 428/400 X |
| 2,536,014 | 12/1950 | Cox | 428/400 X |
| 2,777,775 | 1/1957 | Edwards et al. | 57/244 X |
| 2,834,093 | 5/1958 | Woodell | 428/400 X |
| 3,000,168 | 9/1961 | Penland | 264/197 X |
| 3,007,766 | 11/1961 | Elssner et al. | 264/197 X |
| 3,050,823 | 8/1962 | Woodell | 428/373 X |
| 3,103,732 | 9/1963 | Woodell | 428/373 X |
| 4,242,405 | 12/1980 | Bockno | 428/400 X |
| 4,404,157 | 9/1983 | Angelini et al. | 264/196 X |

*Primary Examiner*—Patrick J. Ryan
*Assistant Examiner*—J. M. Gray
*Attorney, Agent, or Firm*—Finnegan, Henderson, Farabow, Garrett & Dunner

[57] ABSTRACT

A viscose rayon fiber provided with a superior appearance such as a silk-like appearance by arranging a number of microfine stripes over all of the surface of the fiber, and a manufacturing method thereof. This fiber can be used as a fiber constituting a filament, and as a staple fiber.

A viscose rayon filament provided with a superior appearance such as a uniform appearance without nonuniformity by forming each fiber of the filament with a cross sectional shape which is independently different from an irregular state in an axial direction of the filament, and a manufacturing method thereof. This application includes a viscose rayon filament including the features of the two above inventions and a manufacturing method. The viscose rayon fiber and the viscose rayon filament in accordance with the present invention can be broadly used for various applications as products having a superior appearance and quality.

5 Claims, 7 Drawing Sheets

VISCOSE RAYON FIBER HAVING SUPERIOR APPEARANCE

This application is a continuation of application Ser. No. 07/858,428, filed Mar. 24,1992, now abandoned which is a continuation of application Ser. No. 07/414,665 filed Sep. 29, 1989 abandoned.

BACKGROUND OF THE INVENTION

1. Field of the Invention

This invention relates to a viscose rayon fiber having a superior appearance. In particularly, this invention relates to a viscose rayon fiber having improved appearance characteristics such as a superior luster, a superior handling, less irregularity, and less faults or the like, a viscose rayon filament having a superior appearance caused by causing each fiber constituting the filament to have a specific cross sectional shape, and a viscose rayon filament having two of the above characteristics.

2. Description of the Related Art

A viscose rayon fiber can be used as a staple fiber by cutting the viscose rayon fiber to a predetermined length, or as a filament by gathering a plurality of the viscose rayon fibers.

A cross section of the viscose rayon fiber generally has a shape in which a circumferential surface is provided with specific and relatively large concave portions and convex portions, and the circumferential portion of the fiber is constituted by a skin layer having a dense structure. A feature of the viscose rayon fiber is that the fiber has a brilliant luster caused by the above dense structure in the circumferential portion of a surface thereof. Although, the above luster is often desirable for a specific application e.g. apparel, in practice, a viscose rayon fiber having less luster and a softer handling is preferable for other applications. Therefore, many methods of improving the luster have been proposed. Especially, many long term studies on technical improvements giving the luster and the handling of a natural fiber, such as cotton fiber or a silk fiber, to the viscose rayon fiber have been made.

In a method generally used to eliminate the above drawback of the viscose rayon fiber, fine particles of a titanium dioxide or the like are mixed with the viscose rayon fiber to reduce the brilliant luster of the viscose rayon fiber. Most of the dull viscose rayon fibers now used in the market were made by this method. Nevertheless, a degree of whiteness and a handling of the fiber including the fine particles of the titanium dioxide is inventably changed by the lowering of the luster, so that an opaque dull state which can not be recognized as a gentle or soft luster such as a luster of a cotton fiber or a silk fiber appears on the viscose rayon fiber. Many proposals lowering the brilliant luster and improving the handling of the viscose rayon fiber by an inflated viscose fiber in various forms of closed cells or voids are disclosed in, for example, Japanese Examined Patent Publication (Kokoku) No. 41-1292, Japanese Examined Patent Publication (Kokoku) No. 46-7808, Japanese Unexamined Patent Publication (Kokai) No. 54-156819 or the like.

As a technique relating to the above proposals, Japanese Examined Patent Publication (Kokoku) No. 52-59721 proposed an improvement of the lusters by using a fiber having an oblong cross section and including a plurality of closed cells. But although the improvement of luster of the viscose rayon fiber can be obtained by the inflated viscose fiber or the oblong fiber including the plurality of closed cells, a denier of the viscose rayon fiber manufactured by this method is limited to a fiber having a thick denier, and a yarn made of these fibers has many irregularities along a lengthwise direction thereof and a lower mechanical property. Therefore this fiber is not advantageous in practical use.

Various proposals relating to a method of manufacturing a viscose rayon fiber in which a flow velocity of a coagulation liquid is adjusted are disclosed in Japanese Examined Patent publications (Kokoku) No. 45-25335 and No. 45-2533-6, Japanese Unexamined Patent Publication (Kokai) No. 59-47416, No. 59-228013, No. 60-259612 or the like. The proposals disclosed in the above publications are aimed mainly at an increase of the productivity of the manufacturing of the viscose rayon fiber by making a spinning speed very high.

Another feature of the viscose rayon fiber is that a cross section of the fiber has a specific shape such as a chrysanthemum flower or a dried persimmon, and the cross section of the fiber is not precisely the same for each fiber, for example, constituting a filament and in a lengthwise direction of the fiber, but is substantially the same between the fibers and in the lengthwise direction of the fiber. The properties of a filament made of the viscose rayon fiber, the luster of a product such as a woven fabric or a knitted fabric, and a quality of a finished product may depend on a difference of the cross sectional shape and/or a variance of a specified cross sectional shape. Therefore, many studies into improving the uniformity of the cross sectional shape have been made for a manufacturing process of the filament and a finishing process of the product, and many improved methods have been proposed. The manufacturing process of the viscose rayon fiber is a wet spinning method in which a coagulation of a viscose proceeds with a chemical reaction, and accordingly, manufacturing control is generally difficult. Therefore, a method of decreasing an irregularity in the lengthwise direction of the filament by using a continuous process or the like is mainly adopted.

There are many methods of changing a cross sectional shape to change the luster or a handling of a man-made fiber; Namely, many types of the man-made fiber having special cross sectional shape have been developed and several types of the above fibers are in commercial use. A cross sectional shape of the viscose rayon fiber is generally circular having a circumference similar to a chrysanthemum flower, but a viscose rayon fiber having an oblong cross section or a Y-shape cross section is also manufactured.

Further, a yarn constituted of man-made fibers having different cross sectional shapes is disclosed in Japanese Unexamined Patent Publication (Kokai) No. 62-15321 or the like. Further, as disclosed in Japanese Unexamined Patent Publication (Kokai) No. 63-12728, a method of manufacturing a yarn composed of fibers having different materials, in a fiber making process, to change the handling or the quality level of the yarn is generally known.

To apply a specific banding, luster or color of natural fibers to a synthetic fiber, various yarns such as a yarn mixed with fibers having different material, a thick and thin yarn, a yarn blended with fibers having different cross sections, a yarn spun from different polymers or the like have been proposed. For example, a fiber having an irregular cross section similar to that of a natural fiber, such as cotton, wool or the like is disclosed in Japanese Unexamined Patent Publication (Kokai) No. 63-75104. But the yarns obtained by using the methods disclosed in the above publication or the like have a constant regularity for the irregularity of cross section of the fibers obtained, or a denier of the fiber obtained is also changed. Therefore, the quality such as the irregularity, the handling, the lusters or the like of the obtained yarn are very different from those of natural fibers.

SUMMARY OF THE INVENTION

A primary object of the present invention is to provide a viscose rayon fibers having a handling and a luster similar to silk, as well as mechanical properties.

A second object of the present invention is to provide a method of manufacturing the viscose rayon fiber having a handling and luster similar to silk, as well as desired mechanical properties.

A third object of the present invention is to provide a viscose rayon filament having an irregularity of a cross section in an axial direction of the fibers constituting the filament, which irregularity of the fibers is similar to that of natural fibers, without an irregularity of a total denier of the filament.

A fourth object of the present invention is to provide a method of manufacturing the viscose rayon filament aimed in the above third object of the present invention without problems in the manufacturing process.

A fifth object of the present invention is to provide a viscose rayon filament satisfying the aims of the first object and the third object of the present invention.

A sixth object of the present invention is to provide a method of manufacturing the viscose rayon filament as in the above fifth object of the present invention.

The first object of the present invention is achieved by a viscose rayon fiber having a superior appearance, characterized in that a number of microfine stripes arranged over all the surface of the viscose rayon fiber is 1 or more per 1 $\mu m^2$.

Preferably, the number of the microfine stripes is between 1 and 200, and each is distributed in a substantially different direction against an axis of the fiber on the surface of the fiber.

Further preferable, a depth of the stripe is between 5 nm and 100 nm, a length of the stripe is between 50 nm and 1,200 nm, and a width of the stripe is between 5 nm and 100 nm.

The second object of the present invention is achieved by a method of manufacturing a viscose rayon fiber in which a viscose extruded from a spinning nozzle is sequentially advanced into a first coagulation zone and a second coagulation zone, which have different flow velocities, characterized in that a distance between the spinning nozzle and a spinning tube in which the second coagulation zone is formed is between 2 mm and 15 mm, a mean flow velocity ratio of the coagulation liquid in the first coagulation zone to the coagulation liquid in the second coagulation zone is between 1 to 100 and 1 to 2000, and a mean flow velocity of the coagulation liquid in the second coagulation zone is smaller than a value of a withdrawing velocity of the fiber minus at least 100 m/min.

The third object of the present invention is achieved by a viscose rayon filament composed of a plurality of fibers and having a superior appearance, characterized in that each fiber constituting the filament has a skin and core structure and substantially a same cross sectional area, and a cross sectional shape of each fiber is independently different to an irregular state in the axial direction of the filament.

Preferably, a degree of difference in the cross sectional shape is 30% more.

The fourth object of the present invention is achieved by a method of manufacturing a viscose rayon filament from a viscose, characterized in that the viscose is prepared by mixing two spinning dopes having different regenerating and coagulating characteristics, in a ratio of between 1 to 1 and 1 to 9, and the mixing of the two spinning dopes is adjusted in such a manner that the mixing ratio of fibers constituting the filament of the two spinning dopes differs irregularly along an axial direction of the filament, a mixing ratio of a spinning dope having a lower mixing ratio in the two spinning dopes is 20% or more in a cross section perpendicular to the axial direction of the fiber, and a number of the fibers in which the mixing ratio of the spinning dope having the lower mixing ratio is 20% or more in the cross section of the fiber, respectively, is 30% more than a total number of the fibers constituting the filament.

The fifth object of the present invention is achieved by a viscose rayon filament composed of a plurality of fiber and having a superior appearance, characterized in that each fiber has microfine stripes arranged over all the surface thereof and in a number of 1 or more per 1 $\mu m^2$, has substantially the same cross sectional area, and a cross sectional shape of the each fiber is independently different to an irregular state in the axial direction of the filament.

The sixth object of the present invention is achieved by a method of manufacturing a viscose rayon filament in which a viscose extruded from a spinning nozzle is sequentially advanced into a first coagulation zone and a second coagulation zone which have different flow velocities, characterized in that a distance between the spinning nozzle and a spinning tube in which the second coagulation zone is formed is between 2 mm and 15 mm, a mean flow velocity ratio of the coagulation liquid in the first coagulation zone to the coagulation liquid in the second coagulation zone is between 1 to 100 and 1 to 2000 and a mean flow velocity of the coagulation liquid in the second coagulation zone is smaller than a value of a withdrawing velocity of the fiber minus at least 100 m/min, and the viscose is prepared by mixing two spinning dopes having different regenerating and coagulating characteristics to a ratio of between 1 to 1 and 1 to 9, and the mixing of the two spinning dopes is adjusted in such a manner that the mixing ratio of fibers constituting the filament of the two spinning dopes differs irregularly along an axial direction of the filament, a mixing ratio of a spinning dope having a lower mixing ratio in the two spinning dopes is 20% or more in a cross section perpendicular to the axial direction of the fiber, and a number of the fibers in which the mixing ratio of the spinning dope having the lower mixing ratio is 20% or more in the cross section of the fiber, respectively is 30% more than a total number of the fibers constituting the filament.

DESCRIPTION OF THE PREFERRED EMBODIMENTS

To facilitate understanding of the present invention, the essential technical concept of obtaining a viscose rayon fiber, a viscose rayon filament and methods of manufacturing the viscose rayon fiber and the viscose rayon filament in accordance with the present invention is described in detail with reference to the attached drawings.

First, the viscose rayon fiber belonging to the first invention in this application will be described hereafter.

A strip characterized by having a structure of a circumferential surface of the viscose rayon fiber in accordance with the present invention can be observed from a microphotograph obtained by photographing a replica of a surface of the fiber at a magnification of between 5,000 and 50,000 by a transmission type electron microscope (hereafter, TEM), by observing the surface of the fiber at the magnification of between 5,000 and 50,000 by scanning type electron microscope or the like.

Figure 1:
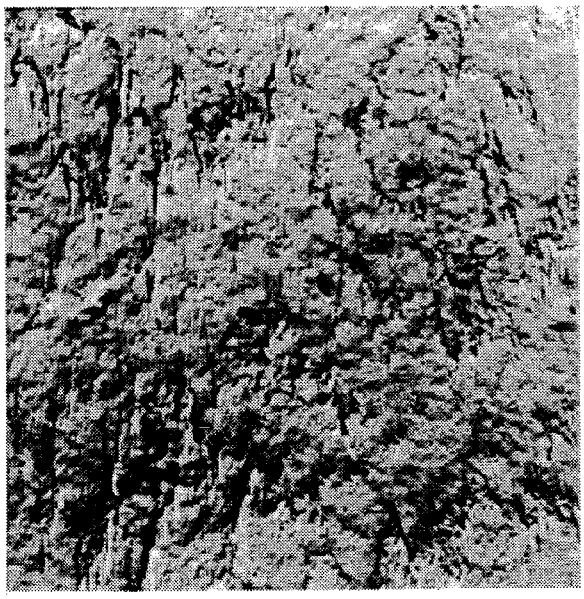
FIG. 1 is a microphotograph at a magnification of 14,000 illustrating a circumferential surface of an example of a viscose rayon fiber in accordance with the present invention.

A microfine stripe expressed in the present invention is denoted as a line having an unevenness or a group of lines observed from a microphotograph of a replica of a surface of the fiber by TEM. FIG. 1 is a microphotograph of a replica of a surface of an example of the viscose rayon fiber of the present invention by TEM. As can be seen in FIG. 1, many microfine stripes are distributed in a direction parallel to an axis of the fiber or a direction inclined to the axis of the fiber over all the surface of the fiber, as a single stripe and/or a group of the stripes, and the stripes sometimes form a saw tooth-like pattern constituted by a plurality of groups of the microfine stripes inclined to the axis of the fiber.

To obtain an improved luster of the viscose rayon fiber in accordance with the present invention, the number of the microfine stripes must be 1 or more per 1 μm of the surface of the fiber, preferably between 1 and 200. Even when the number of the microfine stripes is less than 1 per 1 $\mu m^2$, if the stripes are uniformly distributed on the surface of the fiber, the improved luster of the fiber may be obtained. But, in this case, it is impossible to provide a required soft luster without irregularity along the axis of the fiber.

If there are 1 or more stripes on the surface in the present invention then at least one of the stripes or a portion of the stripe is in a region having an area of 1 $\mu m^2$ and optionally selected from the circumferential surface of the fiber. There are many stripes or portions thereof in the area of 1 $\mu m^2$ in the viscose rayon fiber illustrated in FIG. 1.

It is necessary to arrange the stripes over all the surface of the viscose rayon fiber in the present invention to achieve the soft luster. If the arrangement of the stripes is remarkably biased to any one portion of the surface of the fiber, it is difficult to make a product having a soft luster from those fibers, due to a large irregularity of the luster on the fiber. In the viscose rayon fiber of the present invention, the stripes can be observed from all of the microphotographs obtained by photographing the surface of the fiber from the every direction by TEM.

Figure 2:
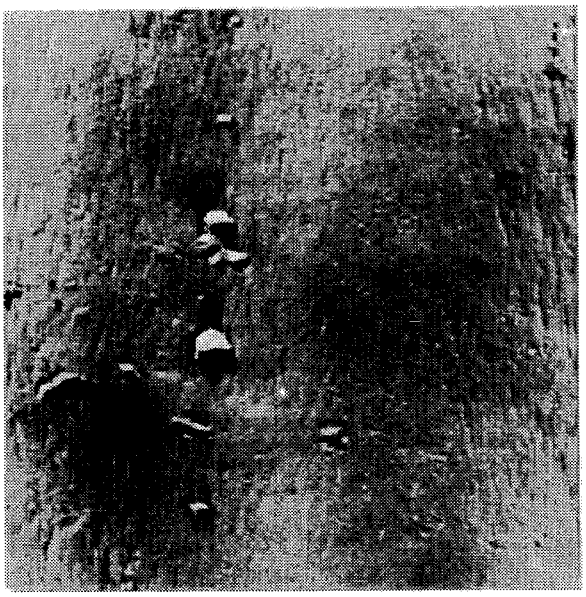
FIG. 2 is a microphotograph at a magnification of the same value as that of FIG. 1 illustrating a circumferential surface of an example of a conventional viscose rayon fiber.

FIG. 2 is a microphotograph of a replica of a surface of an example of a conventional viscose rayon fiber in the same manner as in FIG. 1. As can be seen from FIG. 2, there are no stripes on the surface of the conventional viscose rayon fiber.

Figure 5:
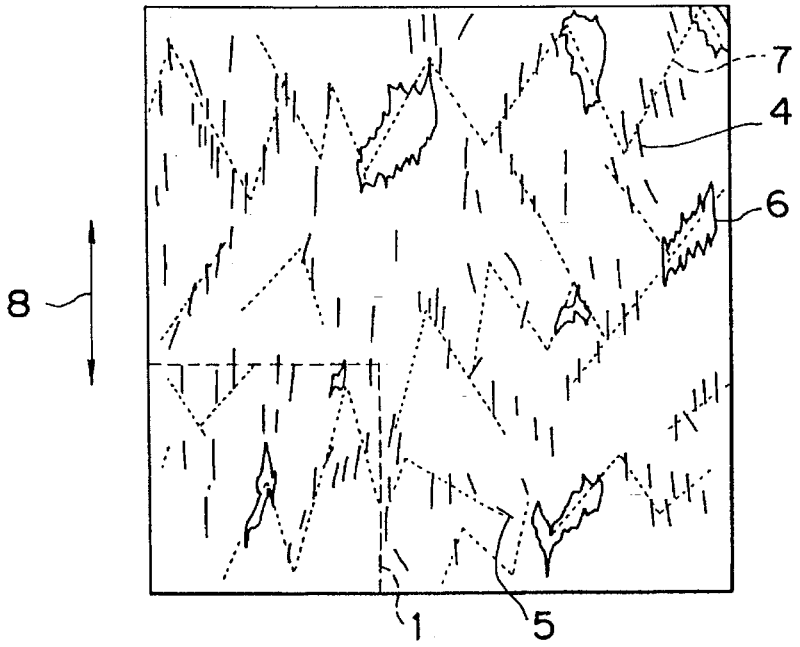
FIG. 5 is a view obtained by schematically sketching the stripes appeared on the circumferential surface of the viscose rayon fiber from the microphotograph of FIG. 1 and illustrating the distribution of the microfine stripes.

FIG. 5 is a view obtained by schematically sketching the stripes appeared on the circumferential surface of the viscose rayon fiber from the microphotograph of FIG. 1, to explain in detail distribution of the microfine stripes. As shown in FIG. 5, the stripes are arranged on the surface as an individual line, as the reference numeral 4 or 5, or as a group 6 composed of several lines or several tens of lines. The directions of the individual line or the line group are not always constant, but most of the individual lines or the line groups are inclined at a direction 8 parallel to an axis of the fiber. Imaginary lines 7 indicating an arrangement of the individual line or the line group form a zigzag pattern. This zig zag pattern can be also expressed as a rippling wave, a herringbone, or a snake skin pattern, referred to as a wave-row group hereafter. Preferably, the directions of the individual line, i.e., stripe and/or the line group i.e., the group of the stripes are different, to provide a soft luster on the viscose rayon fiber of the present invention.

As clearly shown in FIG. 5, each stripe, each group of the stripes, or the wave-row group is not continuous, but is intermittently arranged, and those groups are arranged over all the circumferential surface of the fiber. The area of 1 $\mu m^2$ is encircled by a broken line and is marked by the the reference numeral 1 in FIG. 5. When this area corresponds to FIG. 1 and the corresponding area in FIG. 1 is observed, it becomes apparent that there are many stripes or stripe groups in this area when the numbers of the stripes or the stripe groups are precisely calculated from the microphotograph of FIG. 1, the number of the stripes is about $10^7$ per $mm^2$, and the number of the stripe groups is about $10^6$ per $mm^2$. Further, a large number of the wave-row groups are distributed on the surface of the fiber.

There is no specific limit to the size of the stripe, but preferably the width of the stripe is substantially 100 nm or less, more preferably between 5 nm and 100 nm, and the length of the stripe is substantially 1200 nm or less, more preferably between 50 nm and 1200 nm. The meaning of "substantially" as used in this portion is that, since the stripes on the surface of the fiber are also caused by other sources such as cracks from a nozzle and/or undissolved impurities in a spinning dope, those stripes caused by the other source should not be included in the stripes applied as a characterizing factor of the present invention. Therefore the size of the stripes of the present invention defined in the above description may be a size calculated from the stripes of about 80% of all the stripes on the surface of the fiber. In the fiber shown in FIG. 1, the width of the stripe is between 20 nm and 50 nm and the length of the stripe is between 100 nm and 800 nm. Assuming that the stripe group forms an oval, a major axis thereof is between 0.5 μm and 2 μm and a minor axis is between 100 nm and 500 nm.

As described above, there are many stripes having a length on the order of several hundred nm on the surface of the fiber, and the stripes of the fiber are distributed in the same range as a wave range of a visible light, i.e., between 400 nm and 700 nm. Therefore, appears that the above matter has a strong relationship to a soft luster of the viscose rayon fiber in accordance with the present invention. Namely, since the luster of the fiber of the present invention on a reflection or an absorption of visible light, when the length of the stripes on the surface of the fiber is near to the wave length of the visible light, it appears that the soft luster is effectively obtained. When the length of the stripes is much larger than the wave length of the visible light, an opaque luster such as a luster of a conventional fiber including a titanium dioxide may be obtained. Namely, it appears that a stripe having a size which can be observed by an optical microscope, is not desirable in the present invention.

There is also no specific limit of a depth of the stripe, but preferably the depth of the stripe is substantially 100 nm or less, more preferably, between 5 nm and 100 nm.

Figure 3:
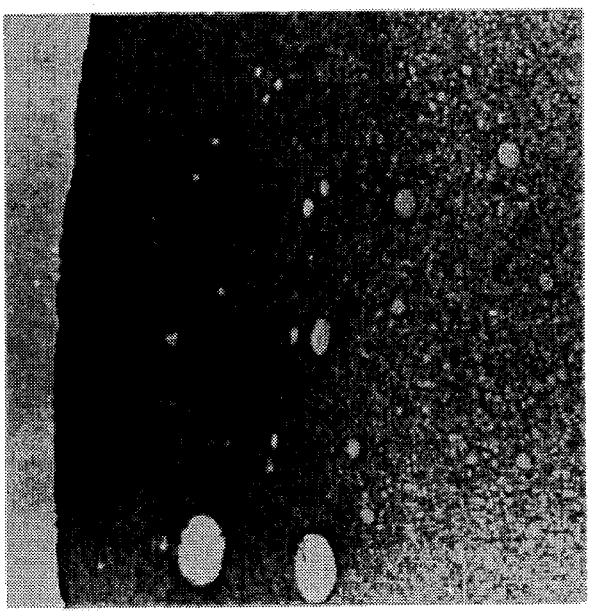
FIG. 3 is a microphotograph at a magnification of 11,000 illustrating a cross section of an example of a viscose rayon fiber in accordance with the present invention.
Figure 6:
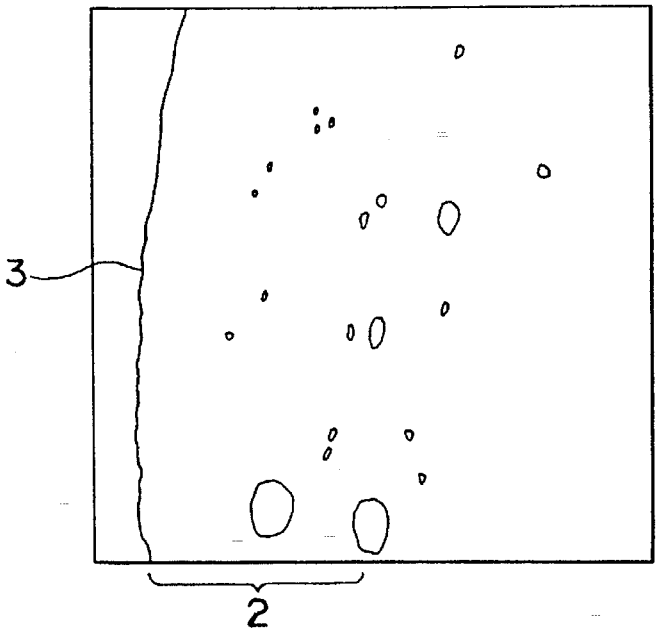
FIG. 6 is a view obtained by sketching the microphotograph of FIG. 3 and illustrating a structure of the cross section of the example of the viscose rayon fiber in accordance with the present invention.

FIG. 3 is a microphotograph at a magnification of 11,000, illustrating a cross section of an example of a viscose rayon fiber in accordance with the present invention and FIG. 6 is a view obtained by sketching the microphotograph of FIG. 3. As seen from FIG. 6, a depth 3 in the cross section of a microfine stripe is several ten nm or less, and this depth 3 of the stripe is extremely small compared with a thickness of a skin layer 2. Therefore the skin layer 2 will not be damaged or marked by the stripe. The stripe should not have a depth such that the stripe pass through the skin layer, or the stripe do not pass through the skin layer but cause deep crack-like marks to appear in the skin layer.

The mechanical properties of the viscose rayon fiber are mainly loaded on those of the skin layer, and when a thickness of the skin layer is small or many cracks or marks appear in the skin layer, the mechanical properties are lowered. Therefore, desirably a skin layer has a uniform cross section of the fiber and is as thick as possible. As shown in FIG. 6, since the microfine stripes on the surface of the viscose rayon fiber in accordance with the present invention are extremely small, the fiber has desired mechanical properties and a soft luster.

The viscose rayon fiber in the present invention is a regenerated cellulose fiber manufactured by dissolving an xanthate derivative of a cellulose in an aqueous sodium hydroxide to make a viscose solution, spinning the viscose solution and coagulating or regenerating the spun viscose to make a fiber. However, the viscose rayon fiber in the present invention excludes a specific viscose rayon fiber, such as a polynosic fiber or the like. The thus-obtained fiber may be either a filament or a staple fiber.

An optional cross section such as a flat cross section, a cross section having a large concave portion and convex portion or the like can be selected as a microscopic shape of a cross section of the viscose rayon fiber of the present invention. Further, a conventional delustering agent such as titanium dioxide can be used for the viscose rayon fiber of the present invention without a lowering of the effect of the present invention. The selection of the cross sectional shape and the use of the delustering agent can be made in an individual or combined state according to an application of the viscose rayon fiber of the present invention.

A polymerization degree of a polymer of the fiber, a degree of orientation in the fiber or the like are not specially limited. Namely a raw material having a general mean polymerization degree of e.g. about 300, used to make a usual viscose rayon fiber, or a raw material having a higher polymerization degree, can be used. Further the other physical properties, e.g., the degree of orientation or the like can be selected according to a manufacturing method of the fiber.

An example of a manufacturing method of the viscose rayon fiber in accordance with the present invention will now be described with reference to FIG. 7.

A viscose stream 14 extruded from a nozzle 11 advances sequentially in a first zone 9 and a second zone 10 of a spinning tube 12 and is guided through a guide 15 to a winding apparatus (not shown). A coagulation liquid is supplied to the first zone 9 from a feeding opening 13 and then exhausted from the spinning tube 12 with the coagulation tube. To obtain the viscose rayon fiber in accordance with the present invention, it is necessary to make a length of the first zone 9 as short as possible, e.g., between 2 mm and 15 mm, to determine a mean flow velocity ratio of the coagulation liquid in the first zone 9 to that in the second zone 10 as between 1 to 100 and 1 to 2000 and to determine a mean flow velocity of the coagulation liquid in the second coagulation zone as a smaller value than that of a withdrawing velocity of the fiber minus at least 100 m/min.

When the length of the first zone 9 is determined as a value of more than 15 mm, a flow resistance of the viscose stream extruded from the nozzle 11 caused by the coagulation liquid is increased, and a spinning stability is reduced, so that the fiber is easily broken. Further, since a thickness of a coagulated film in the surface portion of a fiber becomes thicker in this case, it becomes difficult to determine the flow condition of the coagulation liquid and an operating condition of the apparatus , such that the surface of the fiber is suitably torn away to provide the viscose rayon fiber of the present invention. When the mean flow velocity ratio of the coagulation liquid in the first zone to that in the second zone is determined as 1 to 100, it is necessary to control a thickness of a film formed by a coagulation in the first zone to an extremely thin thickness, and this control is very difficult. It is preferable to not use a condition in which the above mean flow velocity ratio is determined over 1:2000, due to difficulties in controlling a condition under which a flow of the coagulation liquid is stabilized at an entrance or exit of the spinning tube and in the spinning tube.

Under the conditions described above, an extremely thin coagulation film can be formed on the surface of the fiber in the first zone, and the coagulation film then partially torn away by a rapid change of the fluid velocity in the second zone and a withdrawing force on the second zone imposed by the winding apparatus, and the viscose inside of the fiber appears from a split caused by the tearing phenomenon of the film and is in contact with the coagulation liquid, and thus a structure of the viscose fiber in accordance with the present invention is formed. The thickness of the coagulation film formed in the first zone may be several nm, but since the viscose is advancing dynamically in this zone, there is no way to exactly measure the thickness of the film.

To continually carry out the manufacturing method of the present invention under a stable condition, preferably the viscose is spun under conditions of a small flow velocity of the coagulation liquid in the first zone, for example a flow velocity of 3 m/min or less and an apparent draft i.e., a winding speed divided by an extruding speed of the spinning dope of less than 1. Further, as described above, it is necessary to make a mean flow velocity of the coagulation liquid in the second coagulation zone a smaller value than that of a withdrawing velocity of the fiber minus at least 100 m/min. When the spinning operation is performed under the above conditions, the coagulation film on the circumferential surface of the fiber may be torn way by a stretching operation. At the moment of the coagulation operation, since a diameter of the fiber is reduced, accordingly several stripes or wave-row groups running in a direction inclined to an axis of the fiber appear.

When manufacturing the viscose rayon fiber in accordance with the present invention it is necessary to precisely select the coagulation condition according to a spinning dope to be used and a time for which the extruded fiber runs in the first zone. In particularly, it is necessary to select the coagulation condition so that a thickness of a coagulation fiber of the fiber at a position just before entering the second zone does not become too thick.

As a spinning method of the viscose rayon fiber, a tube-type wet spinning method including the above described method, conventional wet spinning method with stantionary multi-bath or the like can be applied under conditions selected according to the qualities of the spinning dope or the coagulation liquid. Further, it is possible to provide a means capable of applying a plasticization drawing effect, such as a steam or the like, between the second zone and the winding apparatus.

It should be noted that the above described manufacturing method of the viscose rayon fiber in accordance with the present invention is a part of the method in which the viscose rayon fiber in accordance with the present invention can be obtained, and this fiber may be manufactured by a method other than that described above.

A viscose dope, used to manufacture a conventional viscose rayon fiber and having a usual composition can be used as a viscose dope for the viscose rayon fiber in accordance with the present invention. Even if a viscose dope having different properties in a reaction quantity of a carbon disulfide, a coagulation property or the like is prepared, this viscose dope can be used by carefully adjusting a composition of the viscose dope and a fiber manufacturing condition, to obtain the viscose rayon fiber.

Next, a viscose rayon filament belonging to a second invention in this application will be described hereafter.

In the viscose rayon filament of the second invention, each fiber constituting the filament has a skin and core structure and substantially the same cross sectional area, and a cross sectional shape of the each fiber is independently different to an irregular state in an axial direction of the filament.

A denier of a cross sectional shape of the fiber of the filament in accordance with the present invention is not generally limited, but usually the denier of the fiber is between 1.5 d and 3.0 d and ratio of a maximum length and a minimum length in the cross section of the fiber is between 1.5 and 30. The filament of the fiber having the above-mentioned denier and the cross sectional shape is broadly used in a woven fabric, a knitted fabric or the like and many proposals have been made for eliminating an irregularity in an axial direction of the filament, i.e., the irregularity of the cross sectional area of the fibers of the filament, to improve a quality level of a product such as the woven fabric or the knitted fabric. The above proposals are mainly concerned with improving the uniformity of the cross sectional shapes of the fibers in the axial direction of the fiber.

To improve a nonuniformity of the filament and the product made of the filament in the present invention, the present invention adapts a technical concept which is opposite to the technical concept adopted for the conventional improvement of the nonuniformity, i.e., the improvement obtained by improving the uniformity of the cross sectional shapes of the fibers in the axial direction of the fiber. Namely, the technical concept of the present invention is that each fiber having a cross sectional shape which is independently different to an irregular state in an axial direction of the fiber is gathered to a filament to improve the nonuniformity of the filament.

The variance of the cross sectional shape of each fiber constituting the filament in accordance with the present invention is large in the axial direction of the fiber, and this fiber appears to be an abnormal fiber on the basis of a common sense of a person having an ordinary skill in the art to which the invention pertains. However, the difference of the cross sectional shape of the fibers of the present invention is independent for each fiber, and therefore, when the fibers are gathered to a filament and products such as a woven fabric or knitted fabric are made by gathering or arranging the plurality of filaments, the differences in the micro cross sectional shape of the fibers cannot be recognized by the naked eye, resulting in an extremely uniformity in the macro state.

The cross sectional shape of the fibers of the filament in the present invention can be easily observed by a micro photograph at a magnification of 300 or more.

The skin and core structure of the fiber of the filament in the present invention can be easily confirmed by the two following methods. Namely, the skin and core structure can be obtained by observation of a microphotograph of a cross section or a longitudinal section of the fiber, or replicas thereof observed by a transmission type electron microscope (TEM) at a magnification of 1000 or more. Another simple method of confirming the skin and core structure is that in which a fiber is dyed with a specific dyestuff capable of dyeing only a skin portion of the fiber, and then a cross section of the dyed fiber is observed by a light microscope.

The term "substantially the same" used in the second invention of this application means that the cross sectional area of the fiber is not precisely the same in the axis direction thereof, but is the same within a range in which a variation of the cross sectional area does not affect practical use, and if a difference of the cross sectional areas between two positions at a distance of 100 mm is within several % of the mean cross sectional area, the cross sectional area of the fiber is the same in the present invention. There is a variation of 10% of the cross sectional area in a conventional viscose rayon fiber of the filament controlled in a usual manufacturing method, and this variation is based on the precision of an apparatus used and a production control, and it is impossible to make all the portions in the axial direction of the fiber exactly the same. However, a filament constituted with the fibers having a variance of the cross sectional area of over 10% generally may causes an irregularity of a luster and a color of a dyed filament or fabric, and thus cannot be used in a practical application.

The term "the difference of the cross sectional shape" used in the second invention of this application means that there is a difference shown by at least an one indication of the three following indications A, B and C expressing a characteristic of the cross sectional shape of the fiber, respectively. When a difference of the indication is over 10% for the indications A and B, and is over 1 for the indication C, it is judged that the corresponding fiber has a different cross sectional shape.

Various fibers having different cross sectional shapes at a specified position of the filament are gathered to the filament of the present invention due to independently change of the cross sectional shape in the axis direction of the fiber in the filament. Since the cross sectional shape of the fiber differs at short intervals, the fibers having various cross sectional shapes are arranged automatically in each portion of the filament, and thus fibers having the same cross sectional shapes cannot be arranged at the specified positions of the filament. Even if the cross sectional shapes of the fibers are the same at the specific position of the filament, since the cross sectional shapes of the fibers are independently changed in a position adjacent to the specific position, few of the fibers have the same cross sectional shape along the length of the filament. Therefore, when the filament of the present invention is used for a woven fabric of a plain weave or a knitted fabric in which the filaments are arranged in parallel, it is impossible to recognize a non-uniformity of the luster or of the colour of a dyed fabric caused by the variation of the cross sectional shape of the fibers constituting the filaments in the present invention.

Figure 8:
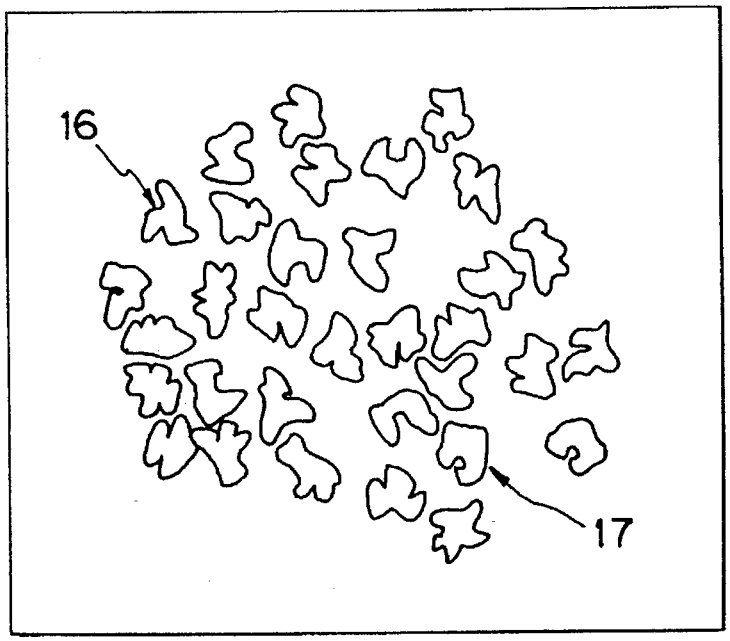
FIG. 8 is an enlarged sketched view illustrating an arrangement and shape of viscose rayon fibers in a cross section of an example of a viscose rayon filament in accordance with the present invention.
Figure 10:
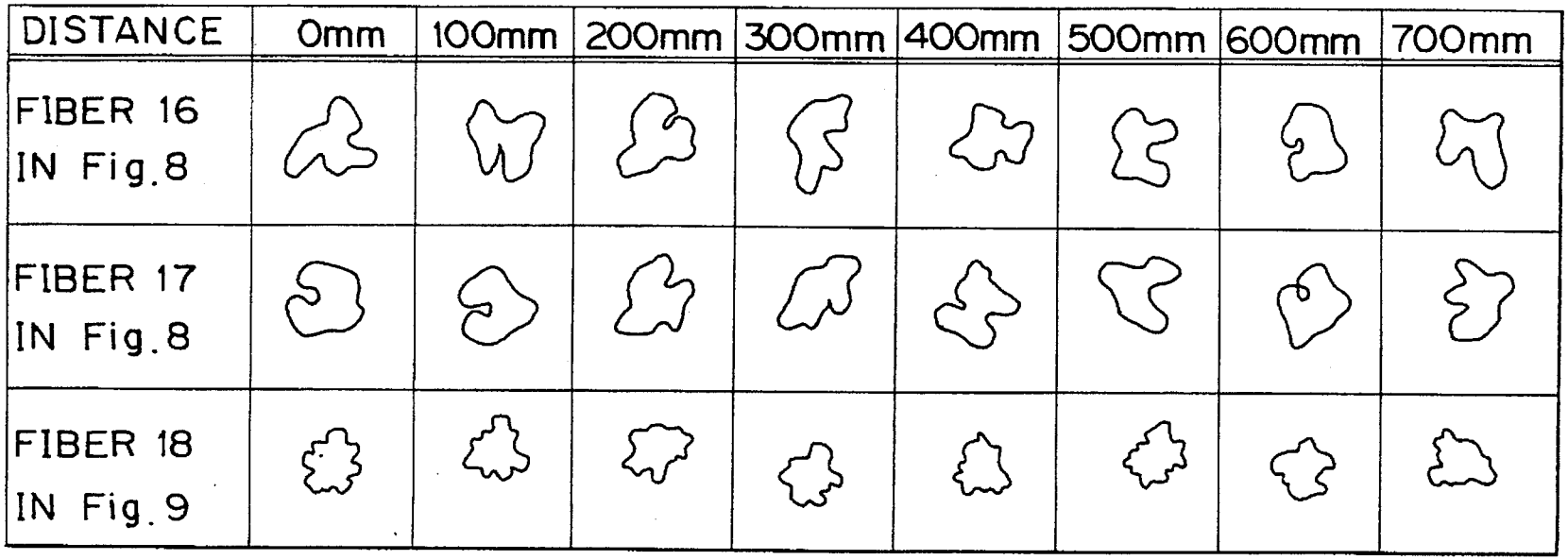
FIG. 10 is an enlarged view illustrating two examples of variations of the cross section of the viscose rayon fiber along an axial direction of the viscose rayon filament in accordance with the present invention, and an example of variations of the viscose rayon fiber along the axial direction of the conventional viscose rayon filament.

The variance of the cross sectional shape of the fibers constituting the filament in the present invention is clearly illustrated in FIGS. 8 and 10. FIG. 8 is an enlarged view of a cross section of an example of a viscose rayon filament in the second invention of the present application, and FIG. 10 is an enlarged view illustrating two examples of variations of the cross section of the viscose rayon fiber along an axial direction of the viscose rayon filament of the present invention, and an example of variations of the viscose rayon fiber along the axial direction of the conventional rayon filament. As can be seen from FIG. 10, the cross sectional shape of the viscose rayon fiber in the filament of the present invention changes at random along the axial direction of the filament, and the change of the cross sectional shape of each fiber is independent. Accordingly, several fibers having different or various cross sectional shapes are arranged in a mixed state in a selected cross section of the filament.

The difference of the cross sectional shape of the fibers in the present invention is determined by detecting that two cross sectional shapes measured at two positions selected optionally at a distance of 100 mm on the same fiber are substantially the same or not. Preferably, the difference expressed by at least an indication in the three above indications A, B, C is over 30%, but even if the difference is slightly under 30%, the effect caused by the filament can be substantially achieved. It is obvious that the larger the difference, the better the effect of the present invention. Further, the larger the number of fibers constituting the filament, the better the effect. Although the two positions remote from each other by a distance of 100 mm are used to evaluate the difference between two cross sectional shapes, the narrower the distance, the more precise the evaluation. The inventors in this application decided that the evaluation is sufficiently at the distance of 100 mm, after many evaluations of various cross sectional shapes and studies of an influence of the distance with regard to a product of the viscose rayon filament. Note, the evaluation of the difference of the cross sectional shape can be made by another evaluation method in which a distance between the two positions is changed.

As described above, when the difference of the cross sectional shapes is over 30%, the effect of the invention can be fully satisfied, but more preferably, the difference of the cross sectional shapes is over 50%, because a range absorbing a variance of the filament and a product made of the filaments against variable factors such as a variance of a manufacturing process, an irregularity of a precision of an apparatus or the like and, an easy production and control thereof, then becomes possible.

Indications expressing the cross sectional shape of the fiber will be now described. Since the cross sectional shape of the fiber in the present invention has various shapes, it is difficult to define a specified value of the cross sectional shape by only one indication. Therefore the three following indications are used in the present invention.

Indication A

Measure expressing a circular degree is calculated by the following equation, $$A = \frac{\pi L^2}{4S}$$

wherein L stands for a maximum length in lengths between two optional points on a circumferential line in the cross section of the fiber, and S stands for a cross sectional area.

Indication B

Measure expressing a deviation of the circumferential line from the circle is calculated by the following equation.

$$B = \frac{M^2}{4\pi S}$$

wherein M stands for a circumferential length of the cross section of the fiber, and S stands for the cross sectional area.

Indication C

Figure 11:
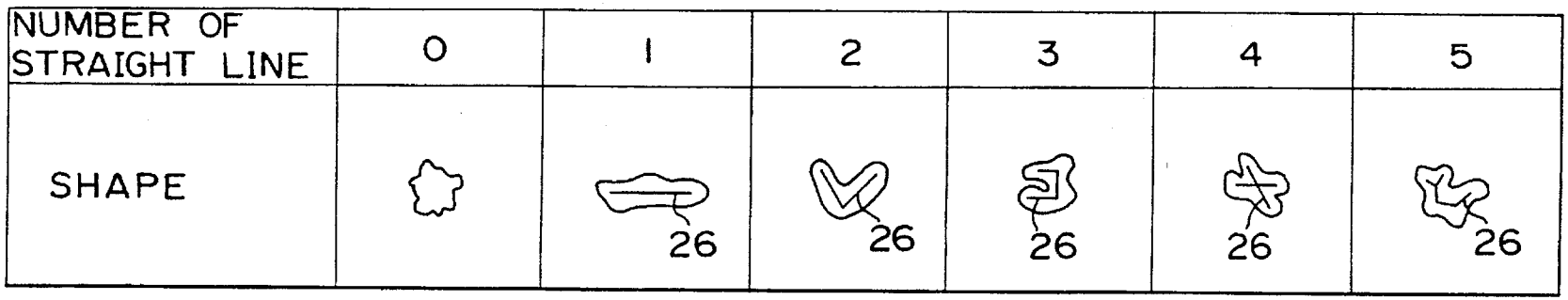
FIG. 11 is a view illustrating typical examples of the cross sectional shape of the viscose rayon fiber in accordance with the present invention, and including straight lines used as an indication C.

Measure expressing a complexity of the cross section shape. As shown in FIG. 11, the cross sectional shapes of various examples are represented by straight line 26 of 1 or more and a number of the straight lines 26 expresses the Indication C.

The cross sectional area S, the maximum length L, and the circumferential length M in the indications A and B can be easily measured a numerically by transferring an enlarged photograph of the cross section of the fiber to a set of points on a screen, converting each point to a coordinate, and processing obtained data by an image processing technique. The above processing technique is widely used, as reported, e.g., "Grinding" No. 33 (1989) P9 to P16, published by the Hosokawa Grinding Engineering Research Laboratory or the like.

A rate of change of each indication will be now explained.

A value of the indication A measured at a position Pn of the fiber is denoted as A(Pn), and a value of the indication A measured at a position Pn' remote from the position Pn by 100 mm is denoted as A(Pn'). A rate of change of the indication A is calculated from the following equation $$\text{Rate of change of } A = \frac{A(Pn)}{A(Pn')} \times 100\%$$

When the rate of change of A is 90 or less, or 110 or more, it is deemed that the indication A has changed, and when the rate of change of A is over 90 or under 110, it is deemed that the indication A has not changed.

A rate of change of the indication B is evaluated in the same way as for the indication A.

With regard to a rate of change of the indication C, the number of straight lines 26 at two positions spaced from each other by 100 mm are calculated when a difference between the two numbers of the straight lines is over 1, it is deemed that the indication C has changed, and when there is no difference between the two numbers, it is deemed that the indication C has not changed.

When there is no change of the indications A, B, and C, it is deemed that the cross sectional shape of the fiber has not changed, and when a change is measured, it is deemed that the cross sectional shape of the fiber has changed.

The above measurement evaluating the change of the cross sectional shape may be applied at several pairs of positions. It is preferable to confirm that the change of the cross sectional shapes of the corresponding fibers exceeds or does not exceed the limits defined in the present invention by a rate of the number of the measurements judged as that the cross sectional shape of the fiber changes between the two positions, against a total number of the measurements.

The indications A and B are slightly affected by variations in the precision of the manufacturing apparatus, a process controlling condition or the like, even if the cross sectional shape of the fiber is substantially the same. Further when the cross sectional shape of the fiber changes under an organoleptic test, i.e., an observation by a naked eye, sometimes the indications A or B do not indicate the change of the cross sectional shape, resulting in a too low evaluation of the change of the cross sectional shape. However, the evaluation used in the present invention may coincide with a result obtained by the organoleptic test at a precision of over 80%.

The filament in accordance with the present invention can be obtained from the same material as that of a conventional viscose rayon filament, without the use of another special polymer. Accordingly, the filament having the same composition as that of the conventional viscose rayon filament can be obtained and it is not necessary to apply a specific treatment and/or a specific consideration for the process in a finishing process of the filament. Further the filament of the present invention also has superior properties such as a high hygroscopicity, colour deployment property or the like of the viscose rayon filament.

It is possible to obtain a viscose rayon fiber having a distorted cross sectional shape made by making a fiber having an irregular skin and core structure or a fiber in which a skin layer is partially destroyed. Since a shrinkage of this fiber differs between the skin layer and the core layer, the obtained fiber has a distorted cross sectional shape. However, the mechanical properties of this fiber are lowered, and this fiber cannot be used in the conventional way. Further, since the fibers constituting the filament of the present invention have the same skin and core structure as that of the conventional viscose rayon filament, the filament of the present invention can obtain the same mechanical properties as those of the conventional viscose rayon filament.

An example of a manufacturing method of the viscose rayon filament in accordance with the present invention will now be described.

The viscose rayon filament in accordance with the present invention can be obtained by spinning two viscose dopes having different regenerating and coagulating characteristics. The inventors of the present invention estimated a principle by which the fibers constituting the filament in the present invention are given an irregular arrangement of the cross sectional shape along an axial direction of the fiber, as follows.

If a portion having a different shrinkage or dehydration rate from those at another portion is arranged in a biased position of a cross section of the fiber, the cross sectional shape changes. If a plurality of these portions are arranged in the cross section of the fiber, the cross sectional shape of the obtained fiber becomes more complex and it is possible to obtain a filament in which the fibers independently have different cross sectional shapes. Further when the ratio of the above portion, i.e., the portion having a different shrinkage or dehydration rate from those at another portion changes along the axial direction of the fiber, fibers in which the cross sectional area changes along the axis direction of the fiber can be obtained.

When using a spinning condition by which the skin and core structure can be obtained, the cross sectional shape of the fibers is changed due to difference of the shrinkage between the skin portion and the core portion, and accordingly, the cross sectional shape of the obtained fiber in the filament is made complicated by combining the above two shrinkage phenomenons, i.e., the phenomenon caused by using two type of viscose dopes and the phenomenon caused by the skin and core structure. The thus-obtained fibers has a random cross sectional shape which does not show any regularity or artificiality.

The conditions of the viscose dope capable of utilizing the former shrinkage phenomenon are many. For example, the viscose dope can be obtained by carefully selecting a concentration of the cellulose, or additives capable of changing a ripening degree, i.e., a coagulation property, a viscosity, or properties of the viscose dope, such as salts increasing the coagulation property, an amine delaying a regeneration of the cellulose. Further, a degree of a dispersion of two viscose dopes having different properties is also affected, and when the dispersion is very poor, manufacturing of the filament becomes impossible due to a breakage of the yarn. When the dispersion is uniform, the uniformly of two viscose dopes in the cross section of the fiber becomes very good, and thus a filament of the fibers having different cross sectional shapes along the axial direction and between the fibers cannot be obtained. Therefore, the degree of the dispersion must be carefully selected according to the properties of the viscose dope used and conditions of the coagulation liquid, or the like.

A conventional mixer, a static mixer, a stream aligning net or the like can be used alone or in a combination, according to the corresponding manufacturing conditions, as a dispersing means. An observation of the degree of dispersion can be obtained by mixing a pigment into a viscose dope of the filament, spinning this viscose dope with another viscose dope which does not include the pigment and observing the cross section of the obtained filament.

Upon spinning the filament of the present invention, it is necessary to carefully determine the spinning conditions according to the spinning spinning dope and the coagulation liquid. A method of a post treatment such as washing, drying or the like may be optionally selected.

A degree of mixture of the two spinning dopes to be spun is preferably between 10% and 50%. When the degree of mixture is under 10%, a strict control of the conditions becomes necessary and this degree of mixture is not recommended. More preferably, the two spinning dopes are mixed in such a manner that an area of a spinning dope having a mixing proportion smaller than that of another spinning dope is over 20% of the total cross sectional area of the fiber. However, even if the same spinning dope occupies an optional cross section, it is sufficient that the spinning dope having a mixing proportion smaller than that of another spinning dope is distributed over 30% of the axial direction of the fiber, to obtain the fiber of the present invention.

It should be noted that the above described method of manufacturing the viscose rayon filament in accordance with present invention is a part of the method in which the viscose rayon filament in accordance with the present invention can be obtained, and this filament may be manufactured by another method.

Next, a viscose rayon filament belonging to a third invention in this application will now be described.

The viscose rayon filament in the third invention is composed of a viscose rayon fiber having the characteristics of the first invention and the second invention. Namely each fiber constituting the filament has various microfine strips giving a soft luster and sufficient mechanical properties, and a cross sectional shape of the each fiber is independently different in an irregular state in an axial direction of the filament. Therefore, when the filament is used for a product such as a woven fabric or a knitted fabric in which a plurality of the filaments are arranged in parallel, the obtained product has a superior and uniform appearance to a degree such that a nonuniformity of the luster and colour of the product cannot be easily observed, and an improvement of the quality level and an elimination or reduction of faults in the products can be efficiently attained.

The method of manufacturing the viscose rayon filament of the third invention can be effected by, for example, using a spinning dope of a viscose capable of differing a cross sectional shape of the fibers constituting the filament and carefully selecting the manufacturing conditions including a spinning condition capable of applying the microfine stripes on a circumferential surface of the fiber.

Upon spinning the viscose, it is important to carefully select the manufacturing condition, compared with conditions selected when manufacturing a viscose rayon fiber having only the microfine stripes, but a post treatment such as washing, drying or the like may be optionally selected.

A feature of a viscose rayon fiber of the first invention in the present invention is that a plurality of microfine stripes are arranged over a circumferential surface of the fiber at a specific density, resulting in a soft luster having no excess brilliance, which is a serious in a conventional viscose rayon fiber. The viscose rayon fiber and a filament composed of a plurality of the viscose rayon fibers in accordance with the present invention has similar mechanical properties to those of the conventional viscose rayon fiber or filament. Further, an effect which is not initially expected is that the viscose rayon fiber having a very tough property can be obtained by the present invention. Namely, a knot elongation retention ratio, i.e., a knot elongation divided by a tensile elongation and a loop elongation retention ratio, namely, a loop elongation divided by the tensile elongation of the present invention, is nearly 90%, and this means that a durability of a bending action of the fiber of the present invention is greater than that of the conventional viscose rayon fiber. Although the contribution of the number of the microfine stripes to the mechanical properties is not fully understood, it is thought that a stress applied on the fiber may be dispersed by the number of the stripes or stripe groups. Therefore, it appears that the behavior of the fiber in the present invention is slightly different from that of the conventional viscose rayon fiber having a smooth surface, when an external force is applied.

It also appears that a tensile strength and a tensile elongation of the viscose rayon fiber do not entirely depend on an extremely thin layer of the fiber, since there are no splits protruding into a skin layer in a micrograph (FIG. 6) illustrating a cross sectional view of the fiber in the present invention, and the fiber of the present invention has a similar tensile strength and tensile elongation as those of the conventional viscose rayon fiber.

Consequently, the extremely microfine stripes cause an irregular reflection of a light to give a soft luster, and further, maintain the tensile strength and the tensile elongation. Therefore, the fiber and the filament constituted with the plurality of the fibers can be used for the same processes, such as weaving, knitting or the like, and can give a soft luster not obtainable by the conventional viscose rayon fiber or filament. Accordingly, the fiber of the present invention can be used in a material for clothing and for a decorative fabric having a silk-like appearance.

A feature of a viscose rayon filament of the second invention in the present application is that the cross sectional shape of the each fiber constituting the filament is independently different in an irregular state in the axial direction of the filament. Therefore, the fibers having different cross sectional shapes, respectively, are mixed on each cross section of the filament, and further, the cross sectional shape of the fiber differs within a short distance in the axial direction of the fiber. This means that the possibility of fibers having the same cross sectional shape being arranged in a cross section of the filament is extremely low, and even if fibers having the same cross sectional shape are arranged at one of the cross sections of the filament, it is not likely to appear that portions in which the fibers constituting the filament have the same cross sectional shape are continuous. Therefore, when the filament of the present invention is used for a woven fabric or knitted fabric in which the filaments are aligned in parallel, the nonuniformity of the luster or the colour becomes small to a degree such that the nonuniformity thereof cannot be observed, resulting in an improved quality level compared with the conventional viscose rayon filament.

The filament in accordance with the present invention has similar mechanical properties to those of the conventional viscose rayon filament. Accordingly, the filament in accordance with the present invention can be subjected to the same treatments, such as weaving, knitting, dyeing and finishing or the like, and a process of manufacturing the filament of the present invention become easier compared with a manufacturing process of the conventional viscose rayon filament in which a uniform control of a cross sectional shape of each fiber is intended.

As described in detail above, a feature of the viscose rayon filament of the third invention in the present application is a combination of the feature of the first invention and the feature of the second invention. Accordingly, when the filament of the third invention is used in a practice, the luster of the filament and a product made of the filament is superior and a nonuniformity of the luster and the colour are remarkably improved.

The present invention will now be further explained by way of examples, which is no way limit the invention.

Before the explanation of the examples, the methods of measuring each characteristic, as used in the present inventions are described as follows.

Observation of a surface of a viscose rayon fiber by TEM.

A fiber is placed on a polymethyl methacrylate (P-MMA) film and pressed at a temperature of 105° C. for 1 hour to produce a replica of the fiber. The film is shadowed by chrome and deposited with carbon in a carbon deposition apparatus. The sample obtained by solving out the P-MMA with chloroform is transferred to a mesh sheet of 150 mesh. The sample is observed and photographed by TEM at a magnification of between 5,000 and 50,000.

Tensile Strength and Elongation

The tensile strength and elongation are measured in accordance with JIS-L-1013 (1981), under the following conditions.

Distance between two grips: 25 cm

Stretching speed: 20 cm/min

Knot Elongation Retention Ratio

A sample having a length of 25 cm is tied at a central point thereof and a knot elongation thereof is measured by the same method as used for the measurement of the tensile strength and elongation. The knot elongation retention ratio is expressed as a value (%) obtained by dividing the obtained knot elongation by the tensile elongation.

Loop Elongation Retention Ratio

Two samples are gripped, so that a loop is made by the two samples, between two grips separated by 25 cm, and a loop elongation is measured by the same method as that used for the measurement of the tensile strength and elongation. The loop elongation retention ratio is expressed as a value (%) obtained by dividing the loop elongation by the tensile elongation.

Evaluation of Luster and Handling

The evaluations of the luster and handling of the sample are performed on the basis of a woven fabric using the sample. The woven fabric has a plain weave and is prepared from a warp yarn of a conventional bright viscose rayon filament of 50 d/20 f and a weft yarn of the sample yarn to be tested, and has a warp density of 107 per inch and a weft density of 74 per inch. The evaluation of the luster and handling is performed by ten inspectors on the basis of an organoleptic test, and each value is expressed as a mean value of the results evaluated by the ten inspectors.

The evaluation standards for the luster and the handling are as follows

Evaluation Standard for Luster Point

5: Soft luster

4: Slightly soft luster

3: Normal

2: Slightly bright luster

1: Very bright luster

Evaluation Standard for Handling

5: Soft handling

4: Slightly soft handling

3: Normal

2: Slightly stiff handling

1: Stiff handling

Evaluation of Nonuniformity I

An evaluation of the nonuniformity I is performed on the basis of a woven fabric. A woven fabric having a plain weave is prepared from a warp yarn of a conventional dull viscose rayon filament of 50 d/20 f and a weft yarn of the sample yarn to be tested, and has a warp density of 107 per inch and a weft density of 74 per inch. The evaluation of the nonuniformity is performed by ten inspectors on the basis of the organoleptic test, and each value is expressed as a mean value of the results evaluated by the ten inspectors.

The evaluation standard is as follows.

5: Nonuniformity not complete (Extremely good)

4: Nonuniformity slight, but no problem in a practical use

3: Normal, substantially no problem

2: Some nonuniformity, problem depends on application and place to be evaluated

1: Obvious nonuniformity, cannot be used

Evaluation of Nonuniformity II

Figure 12:
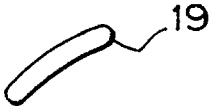
FIG. 12 is an enlarged view illustrating a cross section of the conventional viscose fiber manufactured by a nozzle having an oblong cross section; and, FIG. 13 is a schematic front view illustrating an apparatus used of manufacturing the viscose rayon filament in accordance with the present invention.

An evaluation of the nonuniformity II is performed by a hank made of a twist yarn mixed with fibers to be tested and a specific fiber. Namely, a fiber 19 is manufactured by a normal manufacturing method using a nozzle having an oblong shape of the viscose rayon filament and having a constant cross sectional shape along an axial direction thereof, as illustrated in FIG. 12. The 4 specific fibers and 33 fibers to be tested are twisted at a twist rate of 70 per m and a hank is prepared from the twisted yarn. The nonuniformity of the hank is evaluated by the same method and evaluation standards as used in the evaluation of the nonuniformity I.

A percentage (%) used in the following description means a weight percentage (wt %), except where a special explanation is given.

Example 1

A conventional viscose composed of 8% cellulose, 6% NaOH and a 2.2% sulfur is spun through a coagulation liquid including 11% sulfuric acid, 21% sodium sulfate and 1.2% zinc sulfate at a temperature of 50° C., to produce a viscose rayon filament of Example 1.

Figure 7:
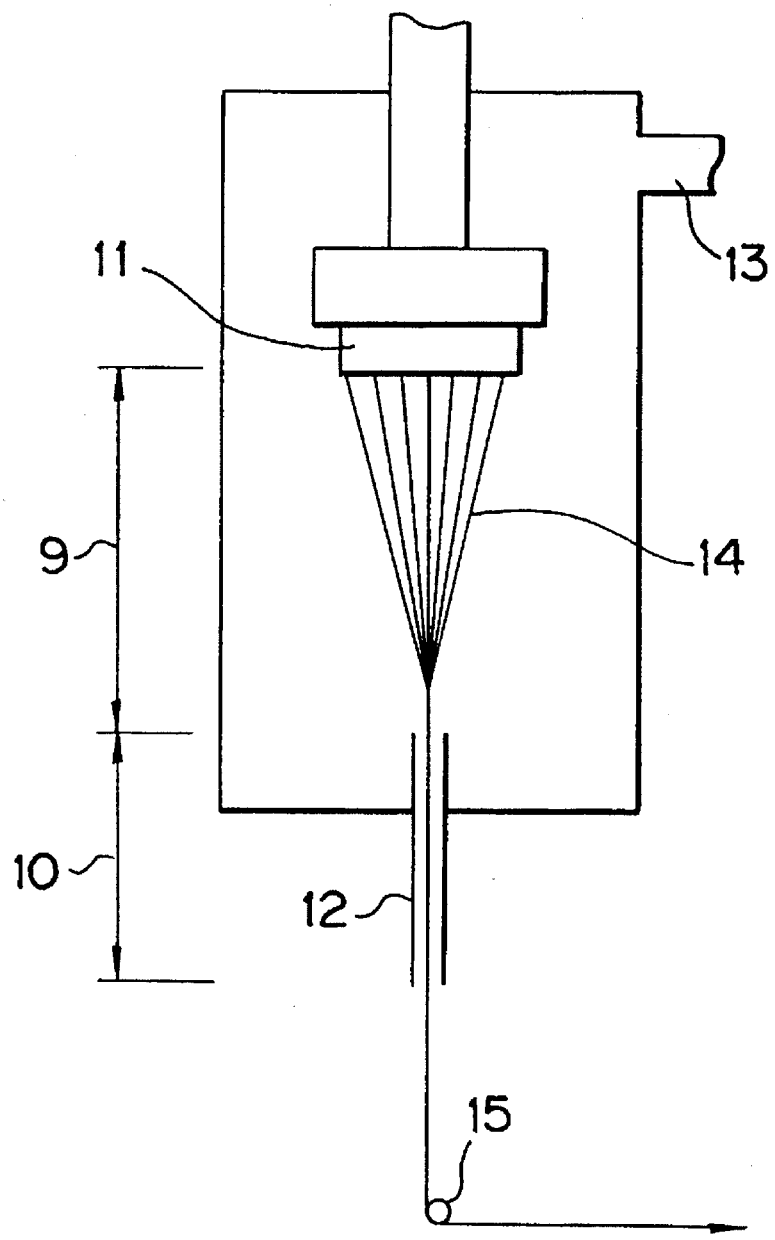
FIG. 7 is a front view schematically illustrating an example of a spinning apparatus used to manufacture the viscose rayon fiber in accordance with the present invention.

The filament is spun by a spinning apparatus illustrated in FIG. 7. The spinning conditions for the viscose rayon filament of Example 1 are as follows.

Nozzle 11 having 33 orifices having a diameter of 50 μφ.

Temperature of a coagulation liquid: 50° C.

Length of a first zone 9: 7 mm

Mean flow velocity of a coagulation liquid in the first zone: 0.35 m/min

Length of a second zone 10, i.e., a spinning tube 12: 40 mm

Mean flow velocity of the coagulation liquid in the spinning tube 12: 200 m/min Apparent draft ratio of extruding velocity of the nozzle 11 and a yarn withdrawing velocity: 0.7

Withdrawal speed of the filament at an exit of the spinning tube 12: 320 m/min Stretch ratio of the exit of the spinning tube and winder (not shown): 1.15

The obtained filament is washed, applied with an oil, and dried by a conventional method to produce a viscose rayon filament of 75 d/33 f.

A microphotograph obtained by photographing a replica of a surface of a fiber in the obtained filament by TEM is illustrated in FIG. 1. Numberless stripes are clearly observed in FIG. 1, and more than 10 stripes are distributed over an area of 1 $\mu m^2$.

A shape of the stripe and properties of the fiber were measured, and the results are as shown in Table 1. The fiber of the Example 1 has a soft luster and a good handling compared with a fiber of the conventional viscose rayon filament.

FIG. 3 is a microphotograph of a cross section of the fiber of the Example 1, taken when the fiber was swollen with an alkali solution, by TEM, and FIG. 6 is an explanatory view obtained by sketching the micrograph of FIG. 3. It can be easily observed from FIG. 6 that a skin layer is uniformly formed over a circumferential surface of the fiber, there is no damage to or slits in the skin layer, and a depth 3 of the microfine stripe in the cross section is extremely short compared with a thickness of the skin layer, i.e., is several tens of nm or less.

When the viscose rayon filament is spun only by changing the temperature of the coagulation liquid to 65° C., a surface of a fiber of the obtained filament becomes smooth and the stripes cannot be observed.

Examples 2 to 7

Viscose rayon filaments of Examples 2 to 7 are manufactured under the same conditions as in the Example 1, except that the following manufacturing conditions were used:

Example 2

Temperature of the coagulation liquid: 55° C.

Mean flow velocity of the coagulation liquid in the spinning tube 12: 160 m/min Withdrawal speed of the filament at the exit of the spinning tube 12: 280 m/min Example 3

Length of the first zone 9: 10 mm

Mean flow velocity of the coagulation liquid in the spinning tube 12: 190 m/min Example 4

Temperature of the coagulation liquid: 48° C.

Mean flow velocity of the coagulation liquid in the spinning tube 12: 170 m/min Example 5

Concentration of the sulfuric acid: 10%

Temperature of the coagulation liquid: 48° C.

Length of the first zone 9: 4 mm

Mean flow velocity of the coagulation liquid in the spinning tube 12: 170 m/min Withdrawal speed of the filament at the exit of the spinning tube 12: 350 m/min Example 6

Temperature of the coagulation liquid: 65° C.

Length of the first zone 9: 4 mm

Length of the spinning tube 12: 50 mm

Withdrawal speed of the filament at the exit of the spinning tube 12: 430 m/min Example 7

A viscose including a titanium dioxide of 0.1% was used.

Figure 4:
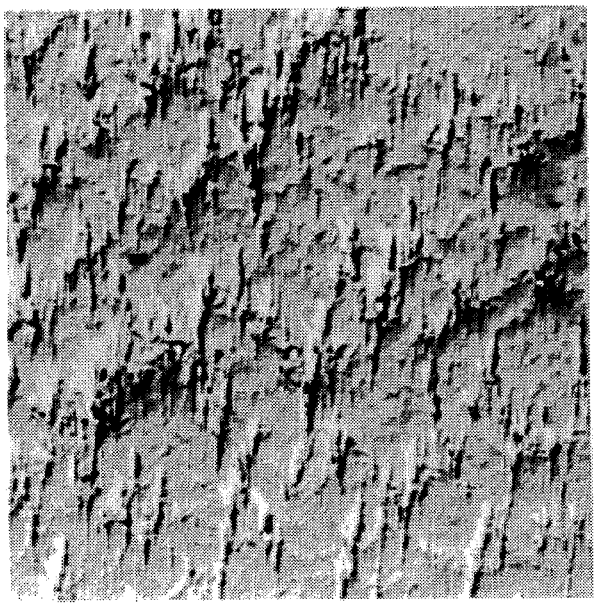
FIG. 4 is a microphotograph at a magnification of 24,000 illustrating a circumferential surface of another example of a viscose rayon fiber in accordance with the present invention.

The number of stripes, the properties, the luster and the handling of Examples 2 to 7 are shown in Table 1. Further, a micrograph of the fiber in Example 6, prepared by the same way as for Example 1, is illustrated in FIG. 4.

Comparative Example 1

A bright viscose rayon filament of 75 d/33 f having a shape of a cake supplied by Asahi Kasei Kogyo Kabushiki-gaisha and manufactured by a centrifugal type spinning method which is widely used as a conventional viscose rayon spinning method, was prepared as Comparative Example 1.

FIG. 2 is a microphotograph obtained by photographing a replica of a surface of a fiber in the filament of Comparative Example 1. As can be seen from FIG. 2, the surface of the fiber is smooth and the stripes cannot be observed.

The number of stripes, the properties, the luster, and the handling of Comparative Example 1 are shown in Table 1.

Comparative Example 2

A semi-dull viscose rayon filament including a commercially available titanium dioxide was prepared as Comparative Example 2.

When observing a surface of the fiber of Comparative Example 2 in the same way for Comparative Example 1, the surface of this fiber is the same as that of the fiber of Comparative Example 1. Namely, the surface is smooth and the stripes cannot be observed.

The number of stripes, the properties, the luster, and the handling of the Comparative Example 2 are shown in Table 1.

Comparative Example 3

A viscose rayon filament of Comparative Example 3 is manufactured under the same conditions as in Example 1, except that a mean flow velocity of the coagulation liquid is changed to 300 m/min. Stripes were not observed on the surface of the fiber constituting the filament of the comparative Example 3.

The number of stripes, the properties, the luster, and the handling of the Comparative Example 3 are shown in Table 1.

Comparative Example 4

Viscose rayon filaments of the Comparative Example 4 are manufactured on the basis of a method disclosed in an embodiment including four examples and four comparative examples of Japanese Unexamined Patent Publication (Kokai) No. 59-228013. The surfaces of all the fibers in this Comparative Examples are smooth and the microfine stripes appearing in the fibers of the present invention cannot be observed.

The stripes, the properties, the luster and the handling of the fibers of an example 2 obtained by using a manufacturing method similar to that of the present invention are shown in Table 1.

Comparative Example 5

The viscose rayon filaments of Comparative Example 5 are manufactured on the basis of a method disclosed in an embodiment including four examples and four comparative examples of Japanese Unexamined Patent Publication (Kokai) No. 59-47416.

The surfaces of all the fibers in this Comparative Example are smooth and the microfine stripes appearing in the fibers of the present invention cannot be observed.

The stripes, the properties, the luster and the handling of the fiber in an example 2, a test No. 3 obtained by using a manufacturing method similar to that of the present invention, are shown in Table 1.

Example 8

Two viscose spinning dopes for forming a viscose rayon filament of Example 8 are prepared under the following conditions, by a conventional manufacturing method.

Figure 13:
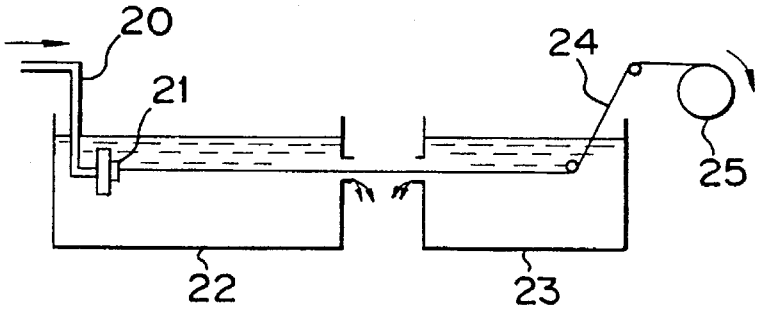

The first viscose spinning dope has a concentration of 8.5% cellulose, 6.0% caustic soda, an γ value of 40, and a viscosity of 50 sec. The second viscose spinning dope has a concentration of 8.0% cellulose, 7.2% caustic soda, 1.8% sodium carbonate, an γ value of 40, and a viscosity of 60 sec. The first spinning dope and the second spinning dope are mixed in a ratio of 7 to 3 by a stirrer to disperse the second viscose spinning dope in the first viscose spinning dope. The dispersing operation is performed so that a size of a spinning dope expressed by a mean diameter becomes about 20 μm and a size expressed by a maximum diameter becomes 60 μm or less. The mixed and dispersed spinning dope is extruded from a gold-platinum alloy nozzle having 33 orfices with a diameter of 0.07 mmφ, into a coagulation liquid. A spinning apparatus illustrated in FIG. 13 is used. The viscose spinning dope supplied from a pipe 20 and extruded from the nozzle 21 is first introduced into a first coagulation bath 22 including 120 g/l of $H_2SO_4$, 260 g/l of $Na_2SO_4$ and 15 g/l of $ZnSO_4$, at a temperature of 60° C., and then further introduced into a second coagulation bath 23 including 150 g/l of $H_2SO_4$ at a temperature of 50° C. The obtained filament 24 is wound at a speed of 120 m/min onto a winding apparatus 25.

The obtained filament is scoured, applied with an oil, and dried by a conventional method to produce a viscose rayon filament of 75 d/33 f.

A microphotograph of a cross section of the filament of the Example 8 was prepared and a view illustrated in FIG. 8 was made by sketching the above microphotograph. Further, several cross sectional shapes of the fibers 16 and 17 constituting the filament of the Example 8 were measured and sketched at intervals of 100 mm, in the same manner as that used in FIG. 8, as illustrated in FIG. 10.

As can be seen in FIG. 10, it is apparent that the cross sectional shape of each fiber differs individually along an axial direction of the fiber.

Indications A, B and C indicating a characteristics of the cross sectional shape of the fiber are measured at 10 positions of the fibers, and the results are shown in Table 2, as a mean value of ten measurements. A rate of the change of the cross sectional shape of Example 8 is 90%.

The physical properties and a nonuniformity of the fiber of Example 8 are shown in Table 3. It is difficult to find a nonuniformity of the filament of the Example 8 compared with a conventional viscose rayon filament.

Comparative Example 6

A bright viscose rayon filament of 75 d/33 f supplied by Asahi Kasei Kogyo Kabushikigaisha and manufactured by a centrifugal type spinning method widely used as a conventional viscose rayon spinning method, is prepared as Comparative Example 6.

A rate of change of a cross section shape of the fibers constituting the filament of Comparative Example 6 is observed in the same manner for Example 8. A microphotograph of the filament of Comparative Example 6 is illustrated in FIG. 9, and a rate of change of the cross sectional shape of the fiber 18 in FIG. 9 is illustrated in FIG. 10.

Figure 9:
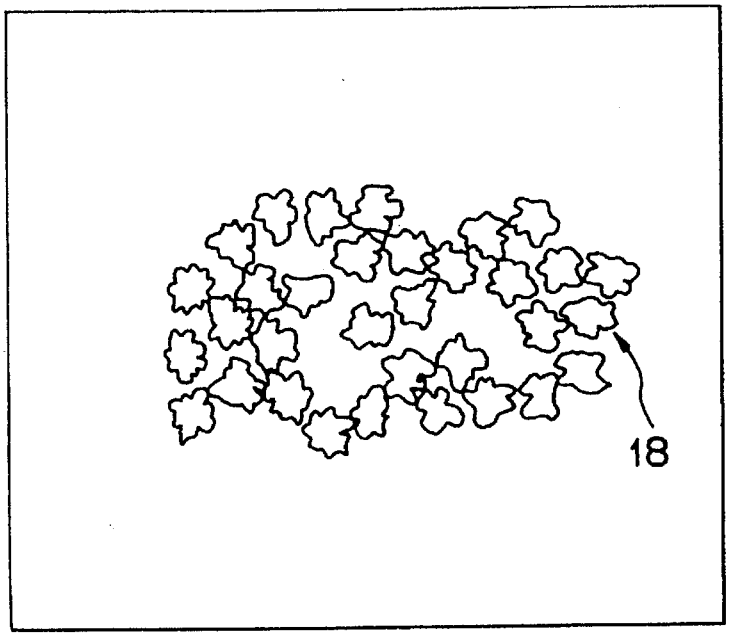
FIG. 9 is an enlarged sketched view illustrating an arrangement and shape of viscose rayon fibers in a cross section of an example of a conventional viscose rayon filament.

As can be seen in FIGS. 9 and 10, the cross sectional shapes of the fibers of the filament of Comparative Example 6 are not substantially changed between the fibers and several portions in the axial direction of the same fiber.

The physical properties and the nonuniformity of the fiber of the Comparative Example 6 are shown in Table 3.

Examples 9 to 12

The viscose rayon filaments of Examples 9 to 12 are manufactured by the same conditions as for Example 8, except that the following manufacturing conditions were used.

Example 9

A mixing ratio of the two viscose spinning dopes is changed to 5 to 5.

Example 10

A composition of $H_2SO_4$ in the second coagulation bath is changed to 100 g/l.

Example 11

A blending ratio of $Na_2CO_3$ in the second viscose spinning dope is changed to 2.5% and the temperature of the coagulation liquid in the first coagulation bath is changed to 50° C.

Example 12

The dispersion of the two viscose spinning dopes is changed so that a size of a spinning dope particle expressed by a mean diameter becomes 10 μm and a size expressed by a maximum diameter becomes about 40 μm.

The rate of change of a cross sectional shape, the physical properties and the nonuniformity for each Example are shown in Table 3. The measurement and the evaluation are made in the same way as in Example 8, except that the evaluation of the cross sectional shape is repeated 100 times.

From the results shown in Table 3, when the rate of change of the cross sectional shape exceeds 30%, it is apparent that it becomes more difficult to observe the nonuniformity.

Example 13

A viscose rayon filament of Example 13 is manufactured by spinning the viscose used in Example 8 by using the coagulation liquid and the spinning apparatus used in Example 1.

The spinning conditions for this Example are as follows.

Nozzle having 26 orifices having a diameter of 50° C. 55 μmϕ.

Temperature of a coagulation liquid: 50° C.

Length of a first zone: 9 mm

Mean flow velocity of the coagulation liquid in the first zone: 0.35 m/min

Length of a spinning tube: 50 mm

Mean flow velocity of the coagulation liquid in the spinning tube: 180 m/min

Withdrawal speed of the filament at an exit of the spinning tube: 300 m/min

Stretch ratio of exit of the spinning tube and a winder: 1.10

The stripes, the properties, the luster and the handling of the Example 13 are shown in Table 1, and the rate of change of the cross sectional shape, the physical properties and the nonuniformity of the Example 13 are shown in Table 3.

The measurement and the evaluation are made in the same way as in Examples 1 and 8.

TABLE 1

| | Unit | Example 1 | Example 2 | Example 3 | Example 4 | Example 5 | Example 6 | Example 7 | Example 13 |
|---|---|---|---|---|---|---|---|---|---|
| Number of Stripes | Number/μm² | 10–40 | 1–10 | 6–30 | 30–100 | 50–150 | 10–40 | 10–40 | 10–50 |
| Depth of Stripe | nm | 20–50 | 20–70 | 20–50 | 10–80 | 10–50 | 20–50 | 20–50 | 20–50 |
| Length of Stripe | nm | 100–800 | 150–600 | 100–900 | 80–1000 | 80–600 | 100–800 | 100–800 | 100–800 |
| Width of Stripe | nm | 20–50 | 20–30 | 10–50 | 10–60 | 10–60 | 10–50 | 10–40 | 20–50 |
| Performance in Weaving Process | — | Good | Good | Good | Good | Good | Good | Good | Good |
| Luster | — | 4.1 | 4.2 | 4.4 | 4.0 | 4.0 | 4.3 | 4.8 | 4.2 |
| Handling | — | 4.5 | 4.7 | 4.5 | 4.7 | 4.3 | 4.4 | 4.6 | 4.5 |
| Tensile Strength | g/d | 1.8 | 1.7 | 1.8 | 1.7 | 1.7 | 1.8 | 1.7 | 1.7 |
| Tensile Elongation | % | 20 | 19 | 18 | 18 | 17 | 19 | 18 | 21 |
| Knot Elongation Retention Ratio | % | 90 | 90 | 92 | 88 | 83 | 89 | 90 | 87 |
| Loop Elongation Retention Ratio | % | 92 | 88 | 90 | 91 | 80 | 94 | 93 | 84 |

| | Unit | Comparative Example 1 | Comparative Example 2 | Comparative Example 3 | Comparative Example 4 | Comparative Example 5 |
|---|---|---|---|---|---|---|
| Number of Stripes | Number/μm² | No | No | No | No | No |
| Depth of Stripe | nm | — | — | — | — | — |
| Length of Stripe | nm | — | — | — | — | — |
| Width of Stripe | nm | — | — | — | — | — |
| Performance in Weaving Process | — | Good | Good | Good | Good | Good |
| Luster | — | 2.0 | 3.2 | 2.8 | 2.3 | 2.7 |
| Handling | — | 4.8 | 4.5 | 4.4 | 3.0 | 2.3 |
| Tensile Strength | g/d | 1.7 | 1.7 | 1.7 | 1.8 | 1.9 |
| Tensile Elongation | % | 21 | 20 | 21 | 18 | 18 |
| Knot Elongation Retention Ratio | % | 72 | 65 | 74 | 52 | 60 |
| Loop Elongation Retention Ratio | % | 70 | 68 | 77 | 55 | 56 |

TABLE 2

| | Pn | 1 | 2 | 3 | 4 | 5 | 6 | 7 | 8 | 9 | 10 |
|---|---|---|---|---|---|---|---|---|---|---|---|
| Indication A | $\frac{A(Pn)}{A(Pn')} \times 100$ | 130 | 106 | 103 | 66 | 68 | 179 | 94 | 78 | 82 | 137 |
| Indication B | $\frac{B(Pn)}{B(Pn')} \times 100$ | 107 | 112 | 100 | 70 | 132 | 74 | 135 | 95 | 85 | 111 |
| Indication C | $\lvert C(Pn) - C(Pn') \rvert$ | 2 | 2 | 0 | 1 | 1 | 3 | 1 | 0 | 0 | 2 |
| Judgement of Change of Cross Sectional Shape | o: Change<br>x: Not Change | o | o | x | o | o | o | o | o | o | o |

Note: Rate of change in Cross Sectional Shape = 9/10 × 100 = 90%

TABLE 3

| | Unit | Example 8 | Example 9 | Example 10 | Example 11 | Example 12 | Example 13 | Comparative Example 6 |
|---|---|---|---|---|---|---|---|---|
| Rate of Change in Cross Sectional Shape | % | 90 | 84 | 51 | 37 | 20 | 80 | 0 |
| Tensile Strength | g/d | 1.8 | 1.8 | 1.7 | 1.8 | 1.7 | 1.7 | 1.7 |
| Tensile Elongation | % | 19 | 20 | 20 | 19 | 22 | 21 | 22 |
| Evaluation I of Nonuniformity | Point | 4.7 | 4.2 | 4.0 | 4.3 | 3.4 | 4.9 | 2.9 |
| Evaluation II of Nonuniformity | Point | 4.4 | 4.0 | 4.1 | 4.0 | 3.1 | 4.4 | 1.5 |

We claim:

1. A viscose rayon fiber having superior appearance characterized in that a number of microfine stripes are arranged over all of the surface of the viscose rayon fiber and the number of stripes is one or more per 1 $\mu m^2$.

2. A viscose rayon fiber according to claim 1 characterized in that the number of the microfine stripes is between 1 and 200 per 1 $\mu m^2$.

3. A viscose rayon fiber according to claim 1 characterized in that each group of the stripes is distributed at a substantially different angle to an axis of the fiber on the surface of the fiber.

4. A viscose rayon fiber according to claim 3 characterized in that the depth of the stripes is substantially between 5 nm and 100 nm.

5. A viscose rayon fiber according to any one of claims 1 to 4 characterized in that the length of the stripes is substantially between 50 nm and 1200 nm and the width of the stripes is substantially between 5 nm and 100 nm.

* * * * *